US006256576B1

(12) United States Patent
Wild et al.

(10) Patent No.: US 6,256,576 B1
(45) Date of Patent: Jul. 3, 2001

(54) METHOD AND DEVICE FOR CONTROLLING OPERATION OF A VEHICLE

(75) Inventors: Ernst Wild, Oberriexingen; Juergen Pantring, Schwieberdingen; Mirjam Steger, Vaihingen; Lutz Reuschenbach, Stuttgart; Michael Order, Illingen; Werner Hess, Stuttgart; Georg Mallebrein, Korntal-Muenchingen; Christian Koehler, Erligheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/432,956

(22) Filed: Nov. 3, 1999

(30) Foreign Application Priority Data

Nov. 3, 1998 (DE) ..... 198 51 974

(51) Int. Cl.[7] ..... F02D 41/26
(52) U.S. Cl. ..... 701/105; 701/1; 123/295
(58) Field of Search ..... 701/1, 101, 102, 701/103, 105; 123/295, 305

(56) References Cited

U.S. PATENT DOCUMENTS 6,029,622 * 2/2000 Kadota et al. ..... 123/295

FOREIGN PATENT DOCUMENTS 36 43 337 C2 11/1991 (DE) .
42 19 669 A1 12/1993 (DE) .

OTHER PUBLICATIONS

Patent Abstract of Japan, 58–222304 A., P–267, Apr. 11, 1984, vol. 8, No. 79.
Patent Abstract of Japan, 2–64703., P–1053, May 28, 1990, vol. 14, No. 249.
"Benzin–Direkteinspritzung—Eine Neue Herausforderung Fuer Zukuenftige Motorsteuerungssysteme", by W. Moser et al, MTZ motoristische Zeitschrift 58, 1997, pp. 458–464.
Fachbuch Direkteinspitzung im Ottomotor, Expert Verlag, ISBN 3–8169–1685, pp. 186–206.

* cited by examiner

*Primary Examiner*—Andrew M. Dolinar
(74) *Attorney, Agent, or Firm*—Michael J. Striker

(57) ABSTRACT

The method for controlling operation of a vehicle having at least two possible operating modes includes calculating and/or determining the operating variables and/or control variables of at least one active one of at least two possible operating modes in a first continually repeated predetermined time interval and calculating and/or determining the operating variables and/or control variables of at least one inactive one of the at least two possible operating modes in at least one other continually repeated predetermined time interval. The first predetermined time interval is shorter than any of the one or more other predetermined time interval(s). A device for performing the method is also described.

8 Claims, 3 Drawing Sheets

METHOD AND DEVICE FOR CONTROLLING OPERATION OF A VEHICLE

BACKGROUND OF THE INVENTION

1. Field of the Invention

The present invention relates to a method of controlling operation of a vehicle and, more particularly, to a method of controlling operation of a vehicle in which at least two different operations modes, whose operating parameters and/or control variables are calculated and/or determined within at least one time-slot pattern, are given in advance.

2. Prior Art

A method for processing of control parameters in an internal combustion engine control system is disclosed in German Patent Document DE 36 43 337 C2. In this method a first pulsed signal is produced for synchronization of the speed of the engine and a second pulsed time constant signal is produced for other purposes. These pulsed signals are present as interrupt signals at the interrupt input of a microprocessor. The microprocessor performs processing steps by which a number of control variables for the engine are controlled according to these interrupt signals. The control variables are based on data that represent the operating states of the internal combustion engine.

The individual processing steps first include processing steps for data to control a first group of control variables according to a rotation speed synchronized interruption called for by the first pulsed signal. A further processing of data in order to control a second group of control variables, according to a time-constant interruption, called for by the second pulsed signal occurs after that. A first flag is set during this processing in order to demand additional data during the rotation speed synchronized process and a second flag is set in order to demand or request additional data during the time-constant processing. Because of the setting of flags a plurality of further and additional data are processed during the absence of an interruption in order to improve the processing efficiency of the data. Since the rotation speed synchronization work has a higher priority, the processing of the second group of control variables is again undertaken when the processing of the first group is finished. Also other processing steps are performed as background processing in addition to both processing sequences, when the above-described interruptions do not occur. Because of this latter feature sufficient processing time and processing capacity are available at high engine speeds.

A method of calculating control variables for repeat control events is also described in German Patent Document DE 42 19 669 A1. In order to reduce bus load and avoid overflow of transferred data, the operating parameter transfer conditions are formulated according to whether or not the value of a calculated control variable has not changed from a given calculated value more than a predetermined limiting amount. When the change of the control variable is not greater than the predetermined limiting amount, the data transfer is suppressed. On the other hand, in order to reduce the required amount of calculations performed by the control device or control unit, the operating condition, whether or not values of particular control variables are already known to have the same values, is tested prior to calculation, so that control variables that are not to be transferred are not calculated at all.

The above-mentioned control method for an internal combustion engine is one application for the prior art method described above. A difference between rotation speed-synchronized and time-synchronized processes with their associated control variables is disclosed in German Patent Document DE 36 43 337 C2. In the method disclosed in this reference the rotation speed synchronized processes have the highest priority. Background processing is only possible when neither of the above-described two processes is active and when no interrupt signal is being processed. Because of these latter features of the method described in DE 36 43 337 C2, control variables are not instantaneously available but must be first calculated according to their respective priorities as required. Differences between two different operating modes of the engine are not accounted for in the method described in DE 35 43 337 C2.

Besides certain control variables are not calculated at all in the method described in DE 42 19 669 A1. A reduction of the processing load depends on the amount of the control variable changes. If the allowed variation in the control variables is too small, the goal of reducing the computational effort is not reached. In order to achieve a significant load reduction, a comparatively large variation in the control variables must be permitted. Because of that the control variables are not instantaneously available or there is a comparatively large tolerance for control variable changes. Here also differences due to two or more operating modes are not accounted for.

According to the prior art the required computations are performed entirely by themselves when possible or with selective functions shut off or suppressed with too great a computational load. Use of different time-slot patterns is not disclosed in the state of the art. Thus only one time-slot pattern is usually used because of the omission of different processing steps for two or more operating modes.

Differences due to different operating modes are accounted for however in internal combustion engine control, for example in connection with fuel injection processes. For example different load levels are taken into account during control of the engine at a partial load level and in operation at full load with a homogeneous mixture. This method is described, for example, in Motortechnischen Zeitschrift [Engine Engineering Journal] (MTZ 58, 1997, pp. 458 to 464) and Fachbuch Direkteinspritzung [Handbook for Direct Fuel Injection in Automobile Engines] (Expert Verlag [Press], ISBN 3-8169-1685-6, pp. 186 to 206). An optimization of the processing load on the engine control unit or in the engine control method is required because of the differences in the various operation modes and the transient changes between them.

SUMMARY OF THE INVENTION

It is an object of the present invention to provide an improved method of and device for controlling operation of a vehicle powered by an internal combustion engine having several different operating modes.

According to the method of the invention claimed in the claims appended hereinbelow, different time-slot patterns are used in systems with at least two operating modes so as to always have small tolerances for the desired control variables. This method is applicable not only for direct gasoline injection processes as mentioned above in connection with the prior art, but also for other applications required for control of the internal combustion engine. The basic concept of the invention is usable for control of arbitrary systems with a plurality of operating states as mentioned above.

The control variables and/or operating parameters and their calculation which are not immediately needed for the active operating mode are shifted to longer time-slot patterns, also calculated or processed less frequently, however are processed deterministically in contrast to the prior art.

The control variables, which are required or desired for the immediately used or active and/or set control mode, are processed or calculated in a faster or more rapid time-slot pattern in contrast to the above-described time-slot pattern. Because of that feature of the method the control variables are set to actual values during changing of the active operating mode. The term "time-slot pattern" or "processing time pattern" means a continually repeated predetermined time interval, for example in a control unit, within the predetermined process, within which, for example, the control variables are calculated, which is similarly started again at the beginning of the next time interval.

In order to have access to the actual values on changing of the active operating mode and for selection of set values for all operating modes, these operating variables must be calculated for all operating modes. This fact increases the computational work many times when different operating modes are used. In order to improve this situation, the computational load in systems with several operating mode variables is reduced by variable processing. Specific variables are only calculated for a particular operating mode in a fast first time-slot pattern, when that operating mode is already set or about to be set. For other operating modes the respective variables, especially set variables and control variables are calculated in at least one slower time-slot pattern. The use of more than two time-slot patterns can be particularly significant.

Another advantage of the method according to the invention is that different operating parameters and/or control variables, especially set variables, for all operating modes are calculated and thus are available without increasing the processor load for selection of the operating mode prior to an operating mode change.

Thus processor resets due to insufficient processing power are avoided. Since these resets, for example, can lead to exhaust gas problems and effect travel behavior of the vehicle during internal combustion engine control, these difficulties can be avoided using the method and device according to the invention.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENT

Figure 1:
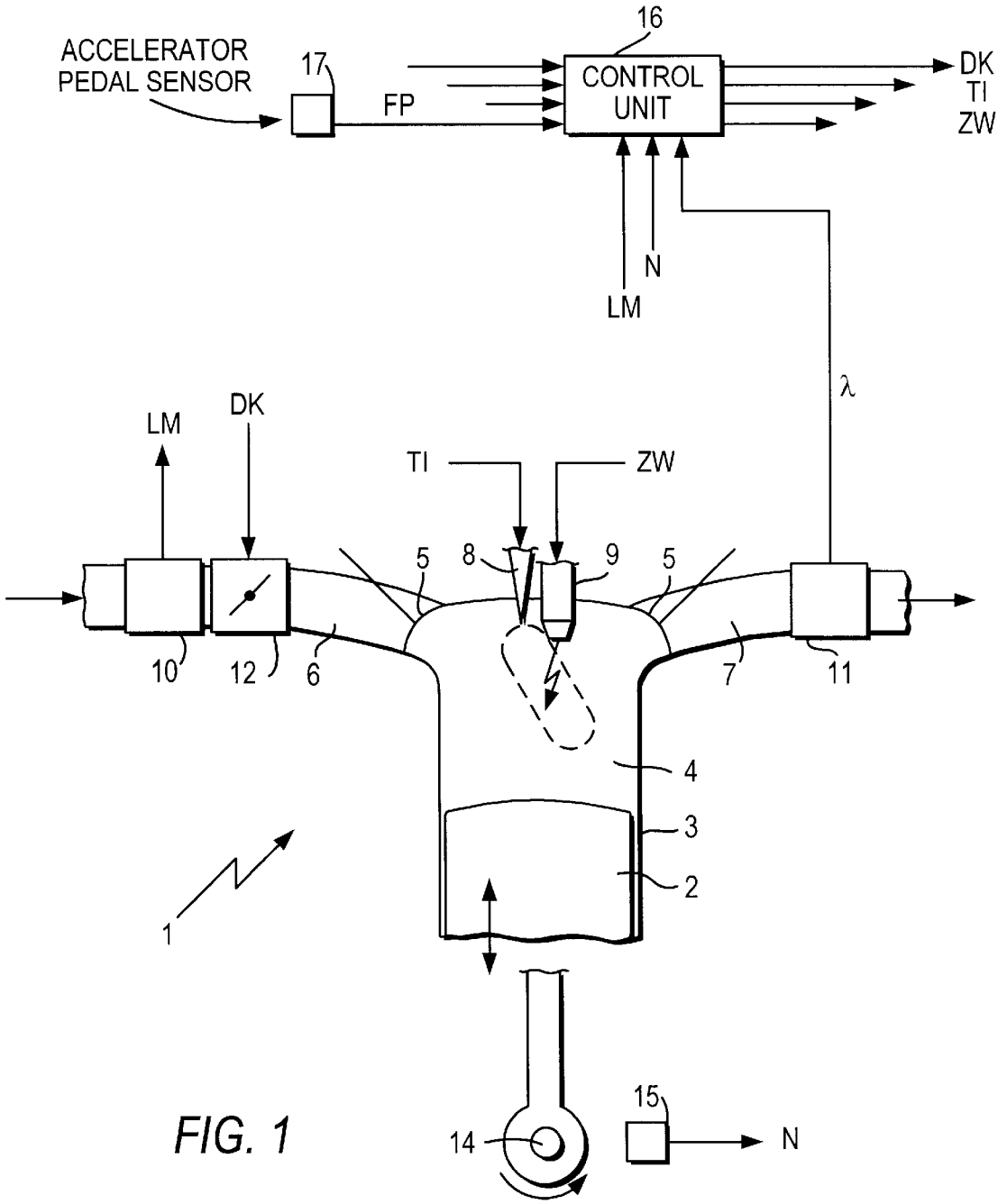
FIG. 1 is a diagrammatic view of a preferred example of an internal combustion engine of a vehicle with a control unit.

One embodiment of an internal combustion engine with direct gasoline injection is shown diagrammatically in FIG. 1. An internal combustion engine, in which a piston 2 reciprocates back and forth in a cylinder 3, is shown in FIG. 1. The cylinder 3 is provided with a combustion chamber 4, which is connected to an exhaust pipe 7 and an intake pipe 6 by means of valves. Furthermore a spark plug 9 controllable with a spark plug control signal ZW and an injection valve 8 controllable with an injection valve control signal TI are arrange in or on the combustion chamber 4. The intake pipe 6 can be provided with an air mass sensor 10 and the exhaust pipe 7 can be provided with a lambda sensor 11. The air mass sensor 10 measures the air mass of the fresh air fed through the intake pipe and produces an air mass signal LM accordingly. The Lambda sensor 11 measures the acid content of the exhaust gas in the exhaust pipe 7 and produces a signal $\lambda$ accordingly.

A throttle 12, whose rotational position is adjustable by means of a throttle control signal DK, is provided in the intake pipe 6

In a first operating mode BA 1, for priority operation of an internal combustion engine, the throttle 12 is wide open. The fuel is injected into the combustion chamber 4 by means of the injection valve 8 during a compression stage produced by the piston, and of course locally in the vicinity of the spark plug 9 and temporally immediately prior to the ignition time. Then the fuel is ignited with the aid of the spark plug 9 so that the piston is driven into the subsequent operating stages by the expansion of the ignited fuel.

In a second operating stage BA 2, for uniform operating of the internal combustion engine 1, the throttle 12 is partially opened or closed according to the desired supplied air mass. During an intake stage produced by the piston 2 fuel is injected into the combustion chamber 4 by means of the injection valve 8. The injected fuel is mixed with the air simultaneously drawn in and thus drawn into the combustion chamber 4 substantially uniformly. After that the fuel/air mixture is compressed during the compression stage, in order to be ignited by the spark plug 9. The piston 2 is driven because of the expansion of the ignited fuel.

In the operating mode BA 1 for priority operation, as in the operating mode 2 for uniform operation, a crankshaft 14 is rotated by the driven piston, by means of which the wheels of the motor vehicle are driven. The crankshaft 14 has a rotational speed sensor 15, which produces a crankshaft rotation speed signal N according to the rotational speed of the crankshaft 14.

The fuel mass injected into the combustion chamber 4 during priority operation and uniform operation by the injection valve 8 is controlled by a control unit 16, especially in regard to a reduced fuel consumption and/or a reduced pollutant emission. For this purpose the control unit 16 is provided with a microprocessor, which has a stored program in a memory device, especially in a read-only-memory (ROM), which comprises means for control or regulation of engine operation. The control unit or control device 16 is acted on by an input signal, which represent operating variables of the internal combustion engine measured by means of sensors. Alternatively, certain variables can be estimated by means of mathematical models and/or according to sensor signals. For example, the control device 16 is connected with the air mass sensor 10, the Lambda sensor 11 and the rotation speed sensor 15. For example, also an air temperature sensor, a motor speed sensor, a stage sensor, a knock sensor and other sensors for determination of the operating variables can be present, according to the respective engine and the operating modes used for its control. Furthermore the control unit 16 is connected with an accelerator pedal sensor 17, which produces an accelerator pedal signal FP, which represents the position of the accelerator pedal operable by the driver of the vehicle.

The control device 16 produces output signals with which the behavior of the internal combustion engine can be influenced by means of actuator devices according to the desired control and/or regulation or the preset operating mode. For example, the control device 16 is connected with the injection valve 8, the spark plug 9 and the throttle 12 and produces the signals TI, ZW and DK required for control.

The different operating modes are switched between each other by or in the control device 16, and the operating variables required for the operating modes are calculated in the control device 16.

One skilled in the motor vehicle arts knows of a lean operating mode, a transition stage between uniform and lean operating modes and a transition stage between uniform and priority operating modes as well as the above-mentioned priority operating mode and uniform operating mode during direct gasoline injection.

The methods mentioned above and illustrated in FIGS. 2 and 3 should advantageously now guarantee the continuous calculation of the operating variables required for different operating modes while simultaneously optimizing the processing or calculation load.

In order to be able to have the actual values of the operating variables available during change of operating mode, and to have the set values for all operating all operating modes available for selection of operating mode, these operating variables must be calculated for all operating modes. This fact increases the processing load by a large factor or multiple during use of several different operating modes. In order to improve operations the calculation load is reduced by variable processing in systems with several operating modes. The operating variables for several operating modes are only calculated in a first fast time-slot pattern, if the operating mode is set or is about to be set. For other operating modes the respective variables, especially set variables and operating variables, are calculated in at least one slower time-slot pattern. The use of more than the two up to now disclosed patterns can thus be significant.

Figure 2:
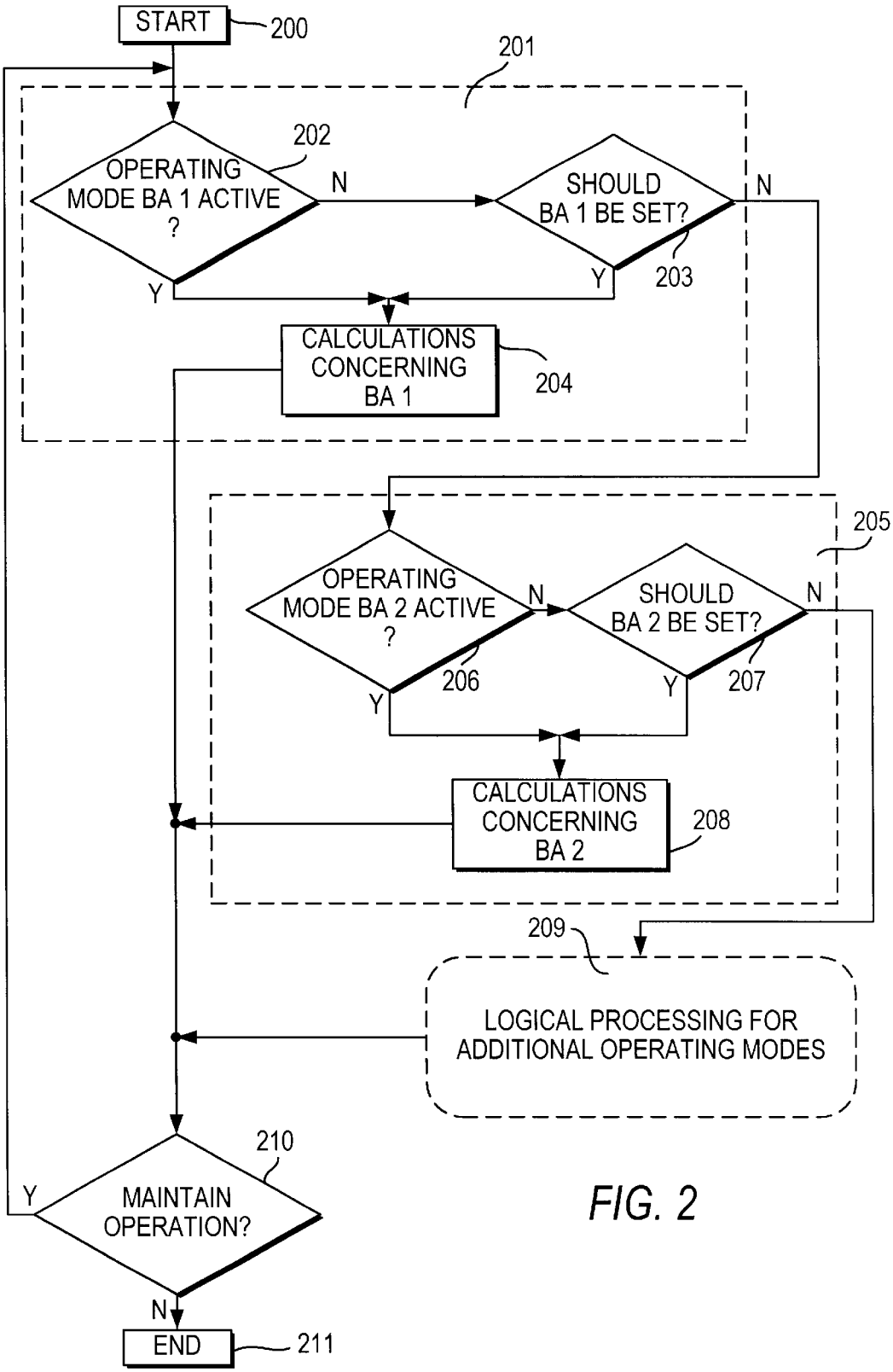
FIG. 2 is flow chart of a portion of a method of control of a vehicle having several operating modes for a first time-slot pattern.
Figure 3:
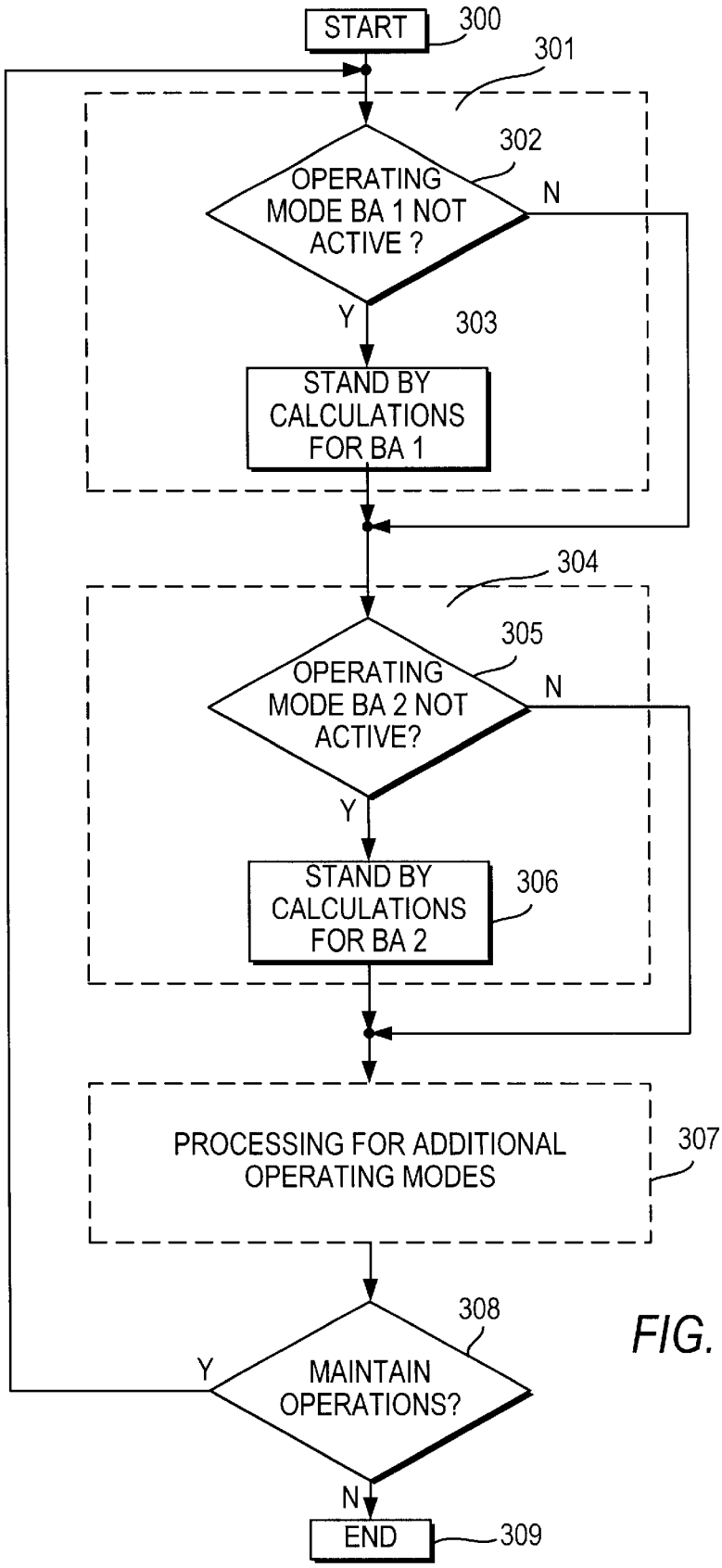
FIG. 3 is a flow chart of another portion of the method for control of a vehicle having several operating modes for another slower time-slot pattern.

The operation of the method in the fast time-slot pattern is shown in FIG. 2. The system start 200 occurs for example by signaling of the spark release or the status of a system processor. After that whether or not a first operating mode BA 1, for example the priority mode, is active, is tested in decision block or step 202. If this occurs, the calculations regarding the operating variables and/or set variables for operating mode BA 1 are performed in step 204. These variables are the throttle position, a fuel injection time in relation to an ignition time, the filling degree, the desired engine torque and the ignition angle for the illustrated embodiment. If the operating mode BA 1 is not active as determined in step 202, whether or not the operating mode BA 1 should be set is determined in decision block or step 203. The information regarding whether or not an operating mode should be set or can be set can be made to depend on the λ limit. A minimum allowed λ and a predetermined fresh gas fill amount is computed for this testing. Furthermore a maximum attainable torque is computed for each operating mode. Whether or not the operating mode should be switched or a predetermined operating mode should be set, is decided on the basis of a comparison with the desired torque. If it is determined that the operating mode BA 1 should be set in decision block or step 203, the operating variables and set values of the variables for this operating mode are again computed in step 204. If the still active operating mode BA 1 should be reset or adjusted, the similar decision test and calculations regarding the second operating mode BA 2 take place in block 205 for processing related to the second operation mode BA 2. Inside the processing block 205 whether or not the second operating mode BA 2 is active at this time is tested in decision block or step 206. If this second operating mode BA 2 is indeed active, the calculations of the operating variables and/or set values of the variables takes place in step or block 208. If this is not the case or if the operating mode BA 2 is not active, whether or not the operating mode BA 2 should be activated is tested in decision block or step 207. If the second operating mode BA 2 is still not active, but should be set, then also the operating variables for operating mode BA 2 are calculated in step or block 208. This second operating mode BA 2 can be the uniform operating mode as in the above-described example. Processing for additional possible operating modes, such as lean operating modes or the transition stage, e.g. between uniform and lean operating modes or between uniform and priority operating modes can optionally occur and be completed in an additional optional block 209. The processing operations occurring in the additional optional block 209 are similar to block 201 or block 205. Whether or not one of these additional optional modes is active is tested and if so the operating variables for this additional operating mode are calculated in additional optional block 209 in the same manner as for the other necessarily present operating modes in blocks 201 and 205. This structure can be expanded or repeated for an arbitrary number of operating modes. The processing continues in decision block 210 from the calculation of the operating variables for the respective operating mode. Whether or not the operation of e.g. the internal combustion engine should be continued is tested in the decision block or step 210. If the operation should be continued, then the method returns to the processing block 201 and particularly to the decision block or step 202 where whether or not the first operating mode BA 1 is active is again tested. This block functions in the same manner whether or not the operation of the e.g. internal combustion engine is to be maintained or not. This can for example occur by testing the system processor and/or testing for spark release as well as various sensor variables, etc. If operation is to be maintained further, processing continues again in the processing block 201 and in decision block or step 202 in which it is determined starting with operating mode BA 1 which operating mode is immediately active and corresponding which operating variables should be calculated and processed in a rapid time-slot pattern or e.g. in a time interval of e.g. 20 ms. If however one obtains the result that the operating and thus the processing should not continue, processing passes to the block or step 211 and is ended. The flow chart of FIG. 2 thus shows the method according to the invention in which the active or to be activated operating mode is determined in order then to compute the required operating variables in the rapid or fast time-slot pattern or in the short time interval. Correspondingly the method according to the invention includes the calculation of the operating variables of the not active operating mode in at least one slower time-slot pattern or time interval, for example of 200 ms duration, in contrast to the calculations performed in the fast time-slot pattern shown in FIG. 2. One possible embodiment which again can be arbitrarily expanded to handle any number of operating modes is shown in FIG. 3. The starting block or step 300 can be identical with the starting block shown in FIG. 2. However it is also conceivable that the start for the processing steps shown in FIG. 3 occurs during the fast time-slot pattern. From start step 300 processing concerning operating mode BA 1 begins in processing block 301. Whether the first operating mode BA 1, for example the priority operating mode as in the preceding embodiment, is active or not is tested in decision block or step 302. If the first operating mode BA 1 is not active, then the associated operating variables and/or set variables are calculated in a standby mode in block or step 303. That means that the variables according to the calculations are expected until a new calculation at a new start of the next time window. Then only the operating variables of the inactive operating modes are calculated in the at least one slower time-slot pattern. If the operating mode BA 1 is active, the calculations regarding this operating mode are not performed in the slower time-slot pattern. Instead of this processing concerning operating mode BA 2 begins in decision block 305 in processing block 304 for the second operating mode BA 2, which for example may be a uniform operating mode. Whether or not second operating block BA 2 is active is tested in decision block or step 305. If the second operating mode BA 2 is not active, the operating variables for this second operating mode BA 2 are similarly calculated in the standby block or step 306. The testing in block or step 305 also occurs after a successful calculation of the operating variables regarding the first operating mode BA 1 in block or step 303. If the operating mode BA 2 is active, the corresponding calculations for that mode are not performed in block or step 306 and processing is transferred directly to optional processing block 307 if it is present. The processing is also transferred to optional processing block when the calculations of the operating variables are successfully completed in block or step 306. Block or steep 307 is optional and processing for other possible operating modes takes place in it in a manner similar to the processing in blocks 301 and 304. Also the processing method is arbitrarily expandable for an arbitrary number of operating modes. After treatment of the last operating mode whether or not operation e.g. of the internal combustion engine should be continued or maintained is tested in decision block or step 308, in a manner that is similar to decision block or step 210 in FIG. 2. If this is not the case, then processing is terminated in step or block 309. If operating should continue however, then processing continues in processing block 301 regarding the first operating mode BA 1 and thus whether or not the first operating mode BA 1 is active is tested again in the decision block or step 302.

Alternatively to the course of the processing FIG. 3 whether the operating variables are calculated for the inactive operating modes one after the other, within an at least one slow time-slot pattern, an significant embodiment can also be provided in which the operating modes which are active are first determined by testing which are active or not, so that the calculations of the individual operating variables in regard to all the inactive operating modes can be performed quasi-parallel within a shorter time window alternately next to each other within the slow time-slot pattern.

In another significant or meaningful embodiment several time-slot patterns are assigned to the inactive operating modes. Each time-slot pattern in which the operating variables for the inactive operating modes are calculated urns slower than the time-slot pattern in FIG. 2 for the active operating mode. The operating modes can experience a prioritizing and a slower or more rapid time-slot pattern can be assigned according to their respective priorities. Thus an additional utilization of processing capacity can be attained.

The disclosure in German Patent Application 198 51 974.5 of Nov. 3, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of controlling operation of a vehicle, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A method for control of operation of a vehicle having at least two possible operating modes for control of said vehicle, said at least two possible operating modes being characterized by respective operating variables and/or control variables, said method comprising the steps of:

a) calculating and/or determining the operating variables and/or control variables of at least one active one of said at least two possible operating modes in a first continually repeated predetermined time interval, said first continually repeated predetermined time interval being a first time-slot pattern; and b) calculating and/or determining the operating variables and/or control variables of at least one inactive one of said at least two possible operating modes in at least one other continually repeated predetermined time interval, said at least one other continually repeated predetermined time interval being at least one other time-slot pattern;

wherein said first continually repeated predetermined time interval is shorter than said at least one other continually repeated predetermined time interval.

2. The method as defined in claim 1, wherein said at least one active one of said at least two possible operating modes is set instantaneously for control of the operation of the vehicle.

3. The method as defined in claim 1, wherein said at least one inactive one of said at least two possible operating modes is not set instantaneously for control of the operation of the vehicle.

4. The method as defined in claim 1, wherein said control of the operation of the vehicle comprises control of an internal combustion engine provided in the vehicle.

5. The method as defined in claim 4, wherein the internal combustion engine has direct fuel injection means and said control of the internal combustion engine includes control of said direct fuel injection means.

6. The method as defined in claim 5, wherein said direct fuel injection means comprises means for injecting gasoline as fuel for said internal combustion engine.

7. A method for controlling fuel injection in an internal combustion engine having a first operating mode for priority operation in which a throttle of the internal combustion is wide open and a second operating mode for uniform operation in which the throttle is partially closed, said method comprising the steps of:

a) determining if the internal combustion engine is operating in the first operating mode or should be operating in the first operating mode;

b) if the internal combustion engine is or should be operating in the first operating mode according to step a), calculating or determining operating and control variables for said first operating mode in a first predetermined time interval;

c) if the internal combustion engine is not and should not be in the first operating mode, determining if the internal combustion engine is operating in the second operating mode or should be operating in the second operating mode;

d) if the internal combustion engine is or should be operating in the second operating mode according to step c), calculating or determining operating and control variables for said second operating mode in a second predetermined time interval independently from the first predetermined time interval; and e) subsequently after one of said predetermined time intervals in the first or second operating mode, determining whether or not operation of the internal combustion engine should be maintained and, if the operation of the internal combustion engine is to be maintained, repeating said steps of said method starting with step a).

8. A device for control of operation of a vehicle having at least two possible operating modes for control of said vehicle, said at least two possible operating modes being characterized by respective operating variables and/or control variables, said device comprising at least one microprocessor;

wherein said at least one microprocessor includes means for calculating and/or determining the operating variables and/or control variables of at least one active one of said at least two possible operating modes in a first continually repeated predetermined time interval acting as a first time-slot pattern and means for calculating and/or determining the operating variables and/or control variables of at least one inactive one of said at least two possible operating modes in at least one other continually repeated predetermined time interval acting as at least one other time-slot pattern, so that said first continually repeated predetermined time interval is shorter than said at least one other continually repeated predetermined time interval.

* * * * *